United States Patent [19]

Baldwin

[11] 4,288,130

[45] Sep. 8, 1981

[54] FILING SYSTEMS AND OTHER COLLAPSIBLE STRUCTURAL UNITS

[75] Inventor: Robert J. Baldwin, London, England

[73] Assignee: H. Geoffrey Lynfield, Old Greenwich, Conn.

[21] Appl. No.: 4,246

[22] Filed: Jan. 17, 1979

[51] Int. Cl.[3] ..... A47B 63/00; A47F 5/14; F16C 21/00

[52] U.S. Cl. ..... 312/183; 312/108; 312/257 SK; 312/330 R; 308/3.6; 211/182

[58] Field of Search ..... 312/183, 257 SK, 257 A, 312/257 SM, 350, 333, 9, 10, 11, 12, 108, 347; 211/182, 187; 308/3.6

[56] References Cited

U.S. PATENT DOCUMENTS

| | | | |
|---|---|---|---|
| 1,429,076 | 9/1922 | Helsley | 312/12 |
| 1,580,744 | 4/1926 | Lyon et al. | 211/182 |
| 1,991,397 | 2/1935 | Lampman | 211/182 |
| 2,848,293 | 8/1958 | Jurgens et al. | 312/333 |
| 3,187,901 | 6/1965 | Wilson | 211/182 |
| 3,265,419 | 8/1966 | Durnbaugh et al. | 312/257 SK |
| 3,265,935 | 8/1966 | Rosa | 312/111 |
| 3,347,608 | 10/1967 | Ritchie | 312/333 |
| 3,664,274 | 5/1972 | Bustos | 312/108 |
| 3,772,572 | 11/1973 | Marquette | 211/182 |
| 3,807,572 | 4/1974 | Luvara et al. | 312/108 |

FOREIGN PATENT DOCUMENTS

| | | | |
|---|---|---|---|
| 18848 | 2/1972 | Australia | 312/183 |
| 2387617 | 4/1978 | France | 312/350 |
| 392458 | 9/1965 | Switzerland | 312/183 |
| 628310 | 8/1949 | United Kingdom | 312/257 A |
| 943077 | 11/1963 | United Kingdom | 312/350 |

*Primary Examiner*—Victor N. Sakran
*Attorney, Agent, or Firm*—Ladas & Parry

[57] ABSTRACT

This invention relates to filing cabinets and knock-down structural units suitable for furniture and enclosures protecting, storing, and housing articles comprising at least two main supports; at least two sets of equi-distant multiple locking slots on each support; and at least two locking frames with multiple bars pressure fitted into said locking slots. In a preferred form, I provide a filing cabinet including drawers slidably supported by the locking frames which also serve as drawer runners.

6 Claims, 24 Drawing Figures

FILING SYSTEMS AND OTHER COLLAPSIBLE STRUCTURAL UNITS

BACKGROUND AND SUMMARY OF THE INVENTION

This invention relates to improved collapsible structural units for use in filing systems, storage units, articles of furniture, temporary housing, containerization, and so on. The aim of this system is to provide a flexible base unit which can be easily arranged to solve a variety of problems, particularly involving storage.

It is sufficiently flexible to cater for both domestic and office needs and industrial uses, while using a minimum number of component parts. The invention avoids the use of nuts and bolts and other conventional fastening means, but uses pressure fitted members which are held together under tension.

As a design problem the criteria has been to use steel in its most apparently articulate manner. This has led to a design which is both functional and aesthetically logical.

The key to the system is the dual action of locking frames, which act as large springs, providing sufficient tension to lock together the main structural supporting frames without mechanical fixtures, so as to achieve structural rigidity without affecting the ease of dismantling the assembly.

The advantage of this system is that it offers a comprehensive range of units from a small number of component parts.

Because it is a knock-up system it is easily transportable and storage costs are reduced.

DETAILED DESCRIPTION

Figure 1:
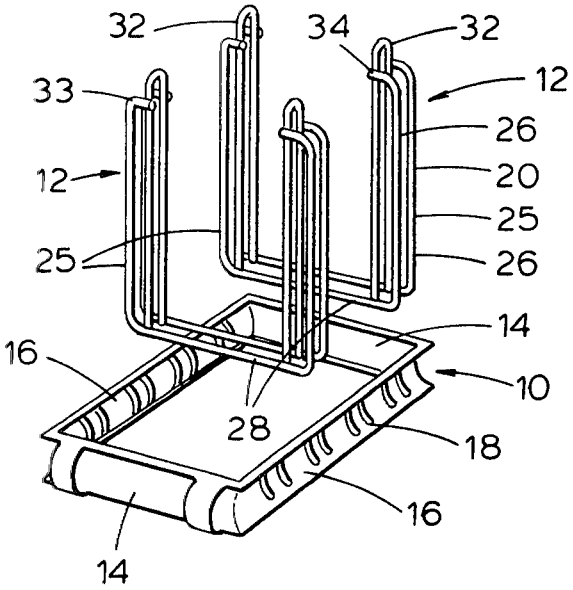
FIG. 1 shows in perspective how the locking frames are slotted into one of the main frames.

The system of the invention provides for a basic unit which essentially consists of two similar rectangular main frames 10 and two similar locking frames 12. The main frame 10 is made from profiled metal section which in the form illustrated in FIGS. 1 through 9 and 11 is of semicircular section. However, as will be described with reference to FIG. 16, the semi-circular section is not essential and the main frames may be made from T- or U-shaped or square sections.

Each main frame 10 has two shorter sides 14 and two longer sides 16. When the frame is in the upright position as shown for instance in FIG. 4, the longer sides are vertically oriented. The longer sides 16 are formed each with two, three or four pairs of aligned locking slots 18. The locking slots are equal in diameter with the outer bars 20 of the locking frame 12. The spacing of the slots 18 in each pair corresponds to the space between the outer bars 20. The spacing between the pairs of slots corresponds to the depth of the drawers 22 (see FIG. 4).

Figure 4:
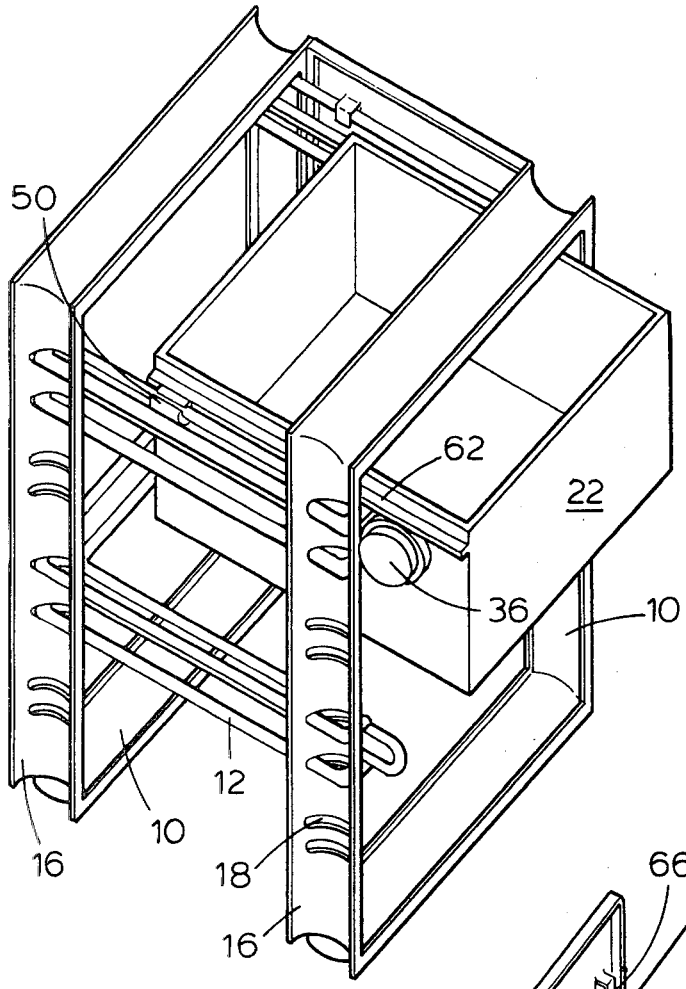
FIG. 4 shows a perspective view of the assembled frames in upright position and with one of the file drawers slid into position.
Figure 5:
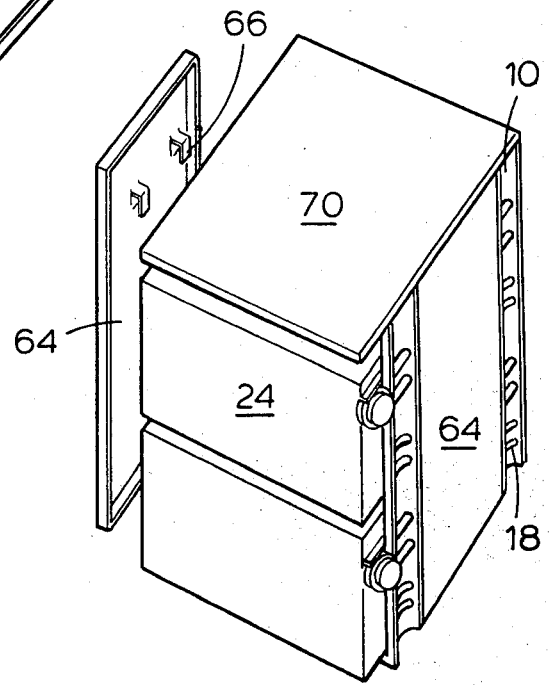
FIG. 5 shows a perspective view of the assembled frames from another angle with two full size drawers in position and side and top panels hung on the completed unit.

FIG. 4 shows the adaptation to a filing cabinet and a shallow drawer suitable for holding cards in position. FIG. 5 shows the unit with two deep drawers 24 suitable for holding files. In the FIG. 5 arrangement, only two of the pairs of slots 18 are being used. The empty slots could be omitted, but may as well be formed in the main frames so as to standardize manufacture. Also, the unit then becomes more interchangeable.

The configuration of the locking frames 12 is best seen in FIG. 1. Each locking frame consists of at least two similar U-shaped outer bars 20. The width between the side legs 25 of bars 20 corresponds to the distance between opposed pairs of locking slots 18 in the longer sides of the main frame. The side legs 26 are joined by an end leg 28 which is lowermost in the position shown in FIG. 1. The pair of outer bars of each locking frame are held together by inner runner bars 30.

The inner runner bars 30 consist of two or more pieces made for instance of a single piece of metal of slightly smaller diameter than the outer bars of the locking frame. These inner runner bars bent double in the form of a hair-pin. The curved ends 32 project slightly beyond the inwardly curved ends 33 of the outer bars 34. When the units are assembled, the curved ends 32 are located towards the front of the unit and hold runners 36 as will be described below.

To assemble the components so far described, one of the main frames 10, which will form the rear of the unit, is placed on the floor and one of the locking frames 12 is thrust into opposed pairs of locking slots 18 until the end legs 28 are flush with the side of the main frame resting on the floor. The second locking frame 12 is then inserted in a second set of opposed pairs of locking slots. Two locking frames only are required to firmly hold the main frames 10 in position. The key to the system is the dual action of the locking frames, which act as large springs, providing sufficient tension to lock the structure without mechanical fixtures, and also serve as drawer runners.

Figure 2:
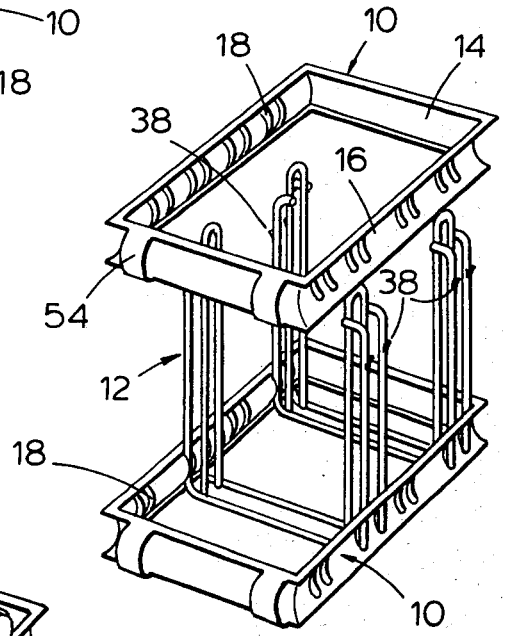
FIG. 2 shows in perspective how the second main frame is placed over the free end of the locking frames.

After two locking frames are in position, a second main frame 10 is placed over the upstanding ends of the locking frames 12 as clearly shown in FIG. 2. The locking frames are formed with small stopping members 38 which can be in the form of nicks or protrusions or welded-on pieces so as to locate the second main frames at a position certain along the length of the side legs 26 of the locking frames. In this way one is assured that the curved ends 32 of the inner bars project the right distance beyond the front main frame (when the unit is upright) and are ready to receive the runners 36. The unit is then at the assembly stage shown in FIG. 3.

As the outer bars 20 of the locking frames are made of the same diameter as the locking slot 20 in the main frame, a moderate amount of force is required to snap the locking frames into the locking slots. The tightness of this fit together with the springiness of the locking frames ensures that the structure is rigidly locked together as soon as the second main frame has been placed over the locking frames. When the assembly, therefore, is in the stage shown in FIG. 3, the four basic components of the unit (the two main frames 10 and the two locking frames 12) form a rigid structure without the use of nuts and bolts, welding or other fastening means.

This positive locking action of the basic components is due to two parallel outer bars of the locking frames being firmly engaged in the locking slots. Each side of the unit is therefore interlocked at eight points and no cross-bracing or the use of special fasteners is therefore required.

Figure 6:
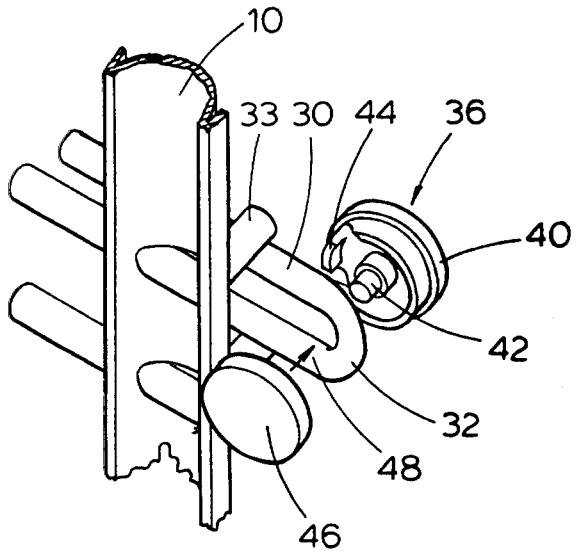
FIG. 6 shows in perspective a detail to a larger scale how an injection molded wheel snaps around the front end of one of the locking frames and acts as a runner for the drawer.
Figure 7:
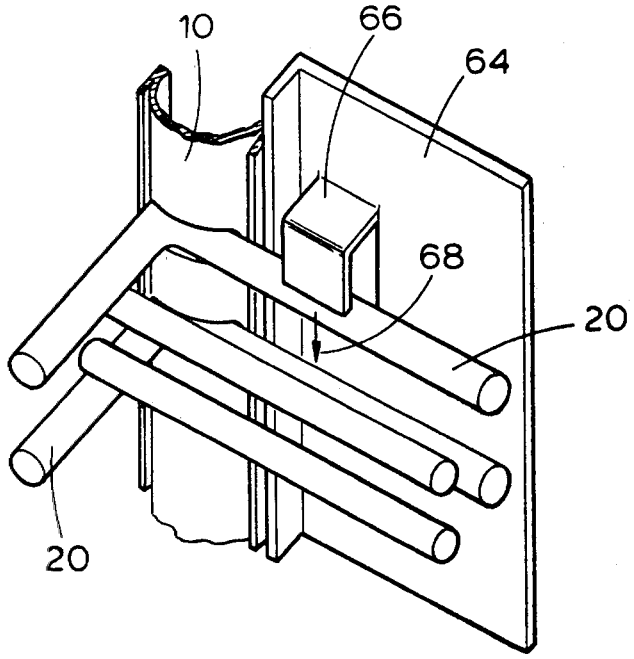
FIG. 7 shows in a similar detail view how the side panelling hangs from the larger bar of the locking frame.

The manner in which the runners 36 are snapped around the curved front end of the inner runner bars 30 of the locking frame is best seen from FIG. 6. An injection molded wheel 40 carrying a stub shaft 42 is placed with an integrally molded locator piece 44 between the inner runner bars 30. A second molded wheel 46 is then applied from the other side of the inner runner bars in the direction indicated by arrows 48. The second wheel has a female piece (not shown) which engages the stub shaft 42 and the two wheel parts are snapped together.

Figure 8:
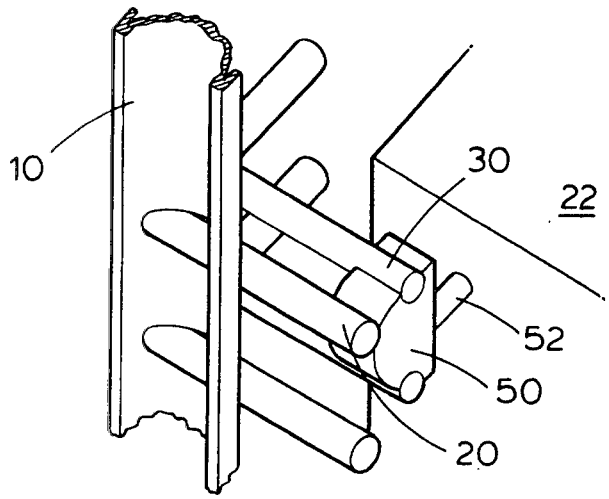
FIG. 8 shows in another detail view how the drawer guide slides between the inner rods of the locking frames and clips into the rear of the drawer.

Before snapping on wheels 40, 46 a drawer guide 50 is placed over the inner runner bars 30 of the locking frame. Each drawer guide is formed with a stub-like projection or knob 52 which is adapted to engage in an opening in the side of the drawer as shown in FIG. 8.

Figure 3:
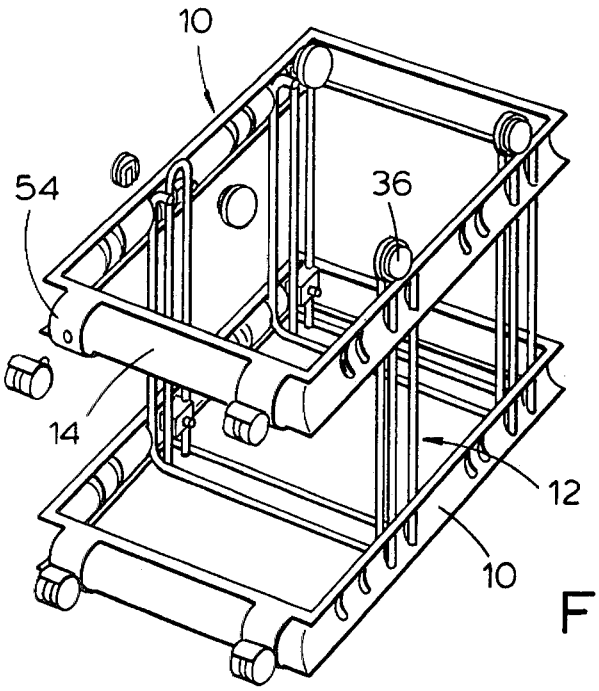
FIG. 3 shows in a similar perspective view how for use in a filing cabinet the wheels are secured in place, and how the front and rear slide components are clipped into position.
Figure 9:
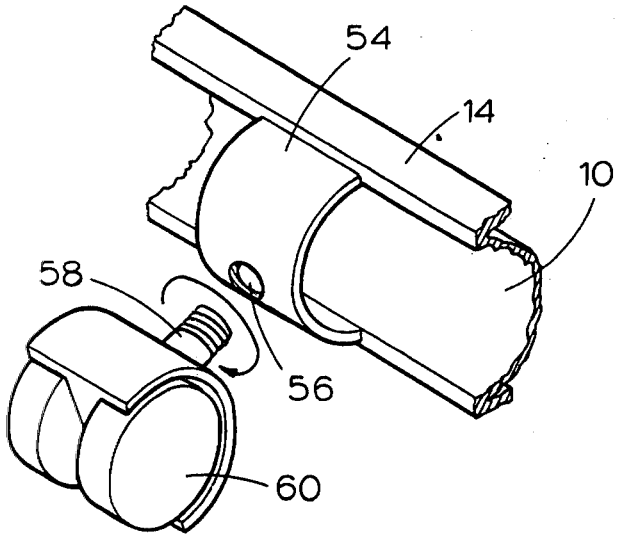
FIG. 9 shows in a further detail view how the ground wheels are located.

One of the shorter sides 14 of each main frame 10, which will be lowermost in the erect position of the unit, is formed with a pair of spaced stirrups 54 forming wheel location feet (see FIGS. 3 and 9). The stirrups are formed, for instance, with threaded openings 56 which are adapted to receive screw studs 58 on wheels 60. The manner in which the wheels 60 are secured in the stirrups 54 may be modified and instead of the wheels, feet or padded supports may be inserted into the stirrups from below.

The assembly of the unit has now reached the stage where the unit can be placed in the upright position shown in FIGS. 4 and 5 and the drawers can be slid in. The drawers are formed with side rails 62 which engage the runners 36.

The units are optionally completed by hanging where and when necessary side panels 64 with hooked members 66 over the outer bars 20 of the locking frame. The side panels can be omitted altogether without affecting the basic structure. These outer bars are of slightly greater diameter than the inner runner bars. The openings of the hooked members 66 are equal to the diameter of the outer bars 20 so that a certain amount of moderate force is required to engage the panels over the outer bars and a certain amount of thrust has to be applied in the direction of arrow 68 in FIG. 7. The side panels are thus securely held in place again without the use of nuts and bolts, or other fastening means.

As a final step, a top panel 70 is placed over the upperpost shorter sides of the main frame so as to form a flat working surface. The top panel is formed with lateral depending lips or edges which again are designed to make a tight fit with the upper sides of the main frame.

Figure 17:
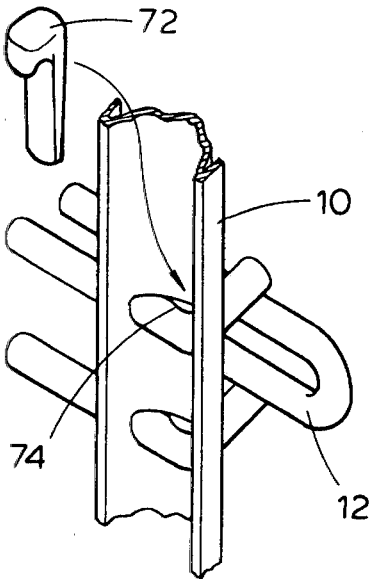
FIG. 17 shows in perspective a wedge locking mechanism.
Figure 18:
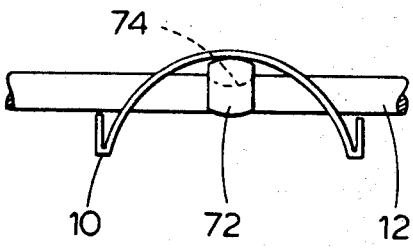
FIG. 18 shows a corresponding plan view with the wedge in position.

The locking action between the locking frames and the locking slots is improved by the use of a locking wedge 72 shown in FIGS. 17 and 18. For this purpose a slight enlargement space is formed between the locking bar 12 and main frame 10. This is accomplished either by an indentation 74 in the locking bar or by making a nick or centrally pressing out the profiled portion of the main frame. A small wedge 72 can be inserted in this manner in each locking point or a longer wedging bar can be forced in to extend across two or more locking points.

Figure 10:
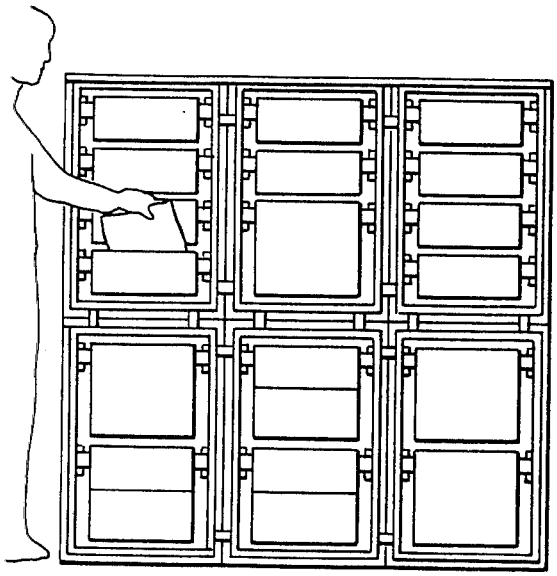
FIG. 10 shows a front elevational view of six stacked units.
Figure 11:
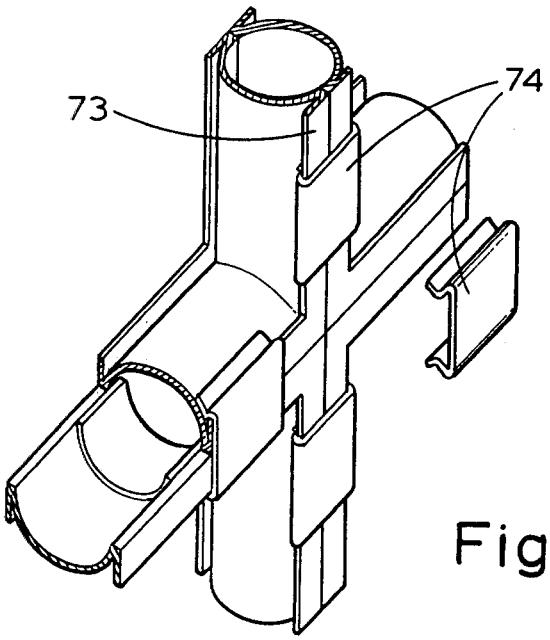
FIG. 11 shows a detail view of the manner in which the stacked units are clipping together.

The completed unit can be stacked in a variety of ways. FIG. 10 shows a two tier assembly of three units side by side. Where one unit is to be stacked above another, the wheel location feet of the top unit sit in the upper main frame of the corresponding bottom unit, acting as vertical location. To hold the units together in stacked array, simple metal clips 74 are placed over the abutting flange 73 of the main frame, see FIG. 11.

Figure 12A:
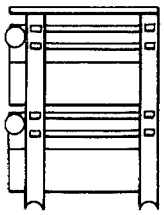
FIG. 12A shows a side view and FIG. 12B a front view of a double width lateral file unit.
Figure 12B:
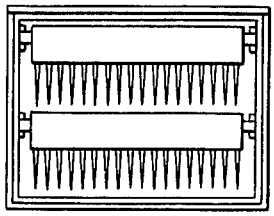
Figure 13A:
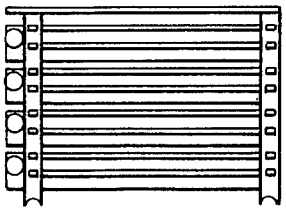
FIGS. 13A and 13B show similar views of a double width four drawer unit suitable for holding drawings or charts.
Figure 13B:
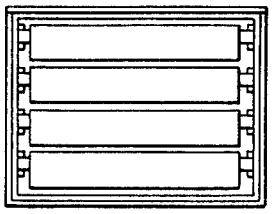

As shown in FIGS. 12A and 12B, the main frames may be made in double width and when combined with two double width/single depth locking frames, the units can be used for holding files in suspended pockets which are well known in the art. In the modification shown in FIGS. 13A and 13B two double width main frames are used in combination with four double width and double depth locking frames. The unit can be then used to hold four drawers for use with charts or drawings.

Figure 14A:
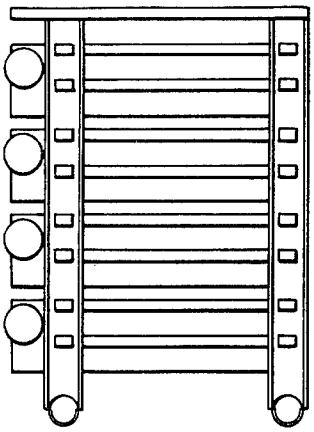
FIGS. 14A and 14B show similar views of a four drawer unit with small main frames and small locking frames.
Figure 14B:
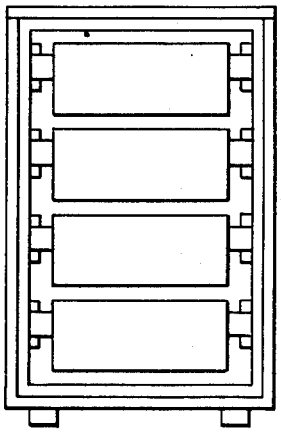
Figure 15A:
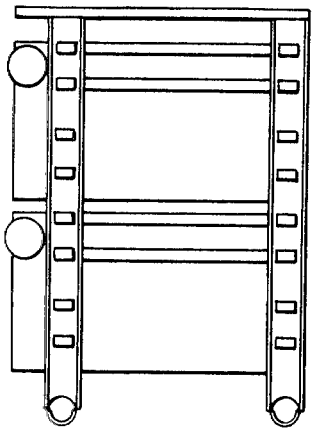
FIGS. 15A and 15B show similar views of a similar unit adapted to hold two deep drawers.
Figure 15B:
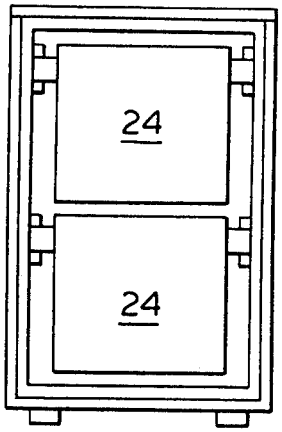

FIGS. 14A and 14B show an arrangement wherein two small (single width) main frames are used with four small locking frames. The unit is then capable of holding four shallow card drawers. By eliminating the second and fourth locking frames (counting from the top) the unit can be readily adapted to hold two deep file drawers 24 as shown in FIGS. 15A and 15B.

Figure 16:
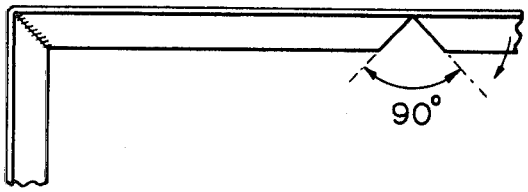
FIG. 16 shows how a T-shaped section is used to form the main frame.

Instead of using a semi-circular section for the main frames, these may be made of U-section or T-section or square section. As shown in FIG. 16, to make the frame a 90° "V" section is cut into the T-bar which is then bent through right angles until the sides of the "V" come into abutting relationship. The corners are then welded together with the frame being held in a jig to assure proper rectangular alignment and configuration of the finished frame.

When stacking units made from T-shaped frames, the metal clips are placed over the T-section in the same manner as over the flanges of the semi-circular section.

Figure 19:
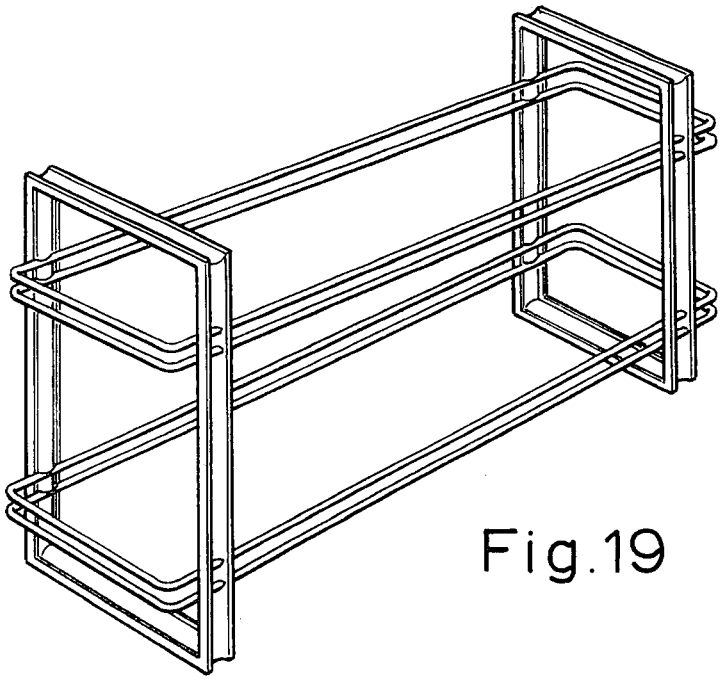
FIGS. 19 and 20 shows the invention applied to a bunk bed and tea wagons respectively.
Figure 20:
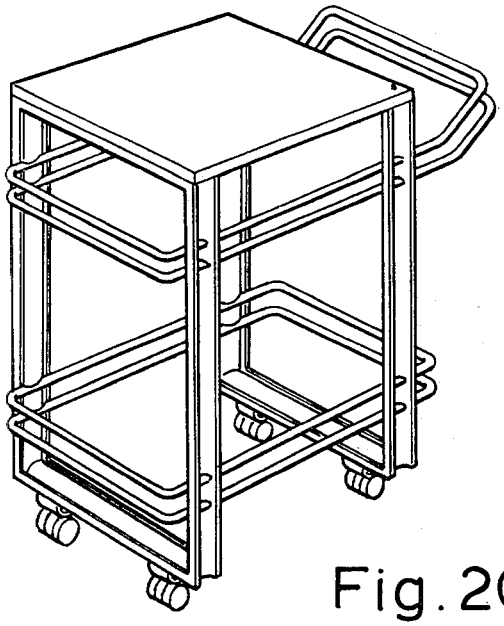

Although the invention has been particularly described as applied to filing cabinets, the basic unit with slight modifications can be used for building other storage units such as book shelves or articles of furniture such as bunk beds as shown in FIG. 19. The main unit can easily be adapted for use for instance as tea wagons, as shown in FIG. 20. The invention with suitable modifications is also applicable to the design of temporary housing such as Quonset huts and containerization with one of the main frames serving as pallet.

It is contemplated that the illustrative and presently preferred embodiments of the invention may be variously modified and otherwise constructed, and it is intended that the following claims be construed to include alternative embodiments except insofar as limited by the prior art.

What is claimed is:

1. A collapsible structural storage unit comprising in combination:

(1) a pair of profiled main frames;

(2) locking slots arranged in pairs along the vertical sides of the said main frames;

(3) at least two locking frames with multiple bars fitting tightly with a spring action into said locking slots and rigidly locking the main frames together; and (4) drawers and like receptacles slidably supported by said locking frames which are also serving as drawer runners.

2. A collapsible structural storage unit comprising in combination:

(1) a pair of profiled main frames;

(2) locking slots arranged in pairs along the vertical sides of the said main frames;

(3) at least two locking frames fitting tightly with a spring action into said locking slots and rigidly locking the main frames together; and (4) drawers and like receptacles slidably supported by said locking frames which are also serving as drawer runners, the locking frames consisting of at least two parallel U-shaped outer locking bars fitting tightly into said locking slots and at least two inner runner bars holding said outer locking bars together and serving as runners for drawers.

3. A storage unit according to claim 2, wherein the inner runner bars are bent double in hair-pin fashion and the rounded ends project towards the front of the unit to hold wheels acting as runners for the drawers.

4. A storage unit according to claim 3, wherein drawer guides slide over the inner runner bars and are engaged into openings at the rear of the drawers.

5. A storage unit according to claim 2, wherein side panels are hung from the outer locking bars.

6. A storage unit according to claim 2, wherein a flat top panel with depending sides is press-fitted over the upper ends of the main frames to form a flat working surface.

* * * * *